US007775175B2

(12) United States Patent
Askestad

(10) Patent No.: US 7,775,175 B2
(45) Date of Patent: Aug. 17, 2010

(54) MOORING PULL-IN SYSTEM

(75) Inventor: Sigmund Askestad, Tvedestrand (NO)

(73) Assignee: Advanced Production and Loading AS, Kolbjornsvik (NO)

( * ) Notice: Subject to any disclaimer, the term of this patent is extended or adjusted under 35 U.S.C. 154(b) by 0 days.

(21) Appl. No.: 11/886,919

(22) PCT Filed: Mar. 21, 2006

(86) PCT No.: PCT/NO2006/000107

§ 371 (c)(1),
(2), (4) Date: Oct. 30, 2007

(87) PCT Pub. No.: WO2006/101401

PCT Pub. Date: Sep. 28, 2006

(65) Prior Publication Data

US 2009/0013918 A1 Jan. 15, 2009

(30) Foreign Application Priority Data

Mar. 22, 2005 (NO) ..... 20051516

(51) Int. Cl.
*B63B 21/24* (2006.01)

(52) U.S. Cl. ..... 114/293; 114/230.2

(58) Field of Classification Search ..... 114/230.12, 114/293, 294, 297, 301, 302, 303, 230.2; 405/169, 206, 224.2
See application file for complete search history.

(56) References Cited

U.S. PATENT DOCUMENTS 3,967,572 A * 7/1976 Lea ..... 114/294
4,020,779 A * 5/1977 Kitt ..... 114/293
4,841,898 A * 6/1989 Ballantyne ..... 114/293
4,958,805 A * 9/1990 Willamsson ..... 114/293
5,522,336 A * 6/1996 Fujita ..... 114/293
5,730,425 A * 3/1998 Brooks ..... 114/293
5,937,780 A 8/1999 Etheridge et al.
6,314,901 B1 11/2001 Smedal et al.
2002/0189522 A1 12/2002 Dove et al.
2003/0143032 A1 * 7/2003 Palmquist ..... 114/230.12

FOREIGN PATENT DOCUMENTS

EP 0 612 655 A2 8/1994
EP 1 318 072 A2 6/2003

* cited by examiner

*Primary Examiner*—Lars A Olson
(74) *Attorney, Agent, or Firm*—Birch, Stewart, Kolasch & Birch, LLP

(57) ABSTRACT

System for anchoring of a vessel, preferably at deep waters, comprising a number of anchoring lines, each anchoring line extending from a fastening means on the vessel to an anchor at the seabed, and the anchoring lines are preferably arranged tightly, obliquely down into the sea around the vessel in the form of spread anchoring, such that the vessel is maintained in a fixed, intended position, distinguished in that each anchoring line is fastened to an anchor and extends out in one length, without joinings, to an upper end where a coupling part is fastened, and the fastening means comprises a crib for each anchoring line, where each coupling part can be laid down in an intended, fastened position.

Figure 1:
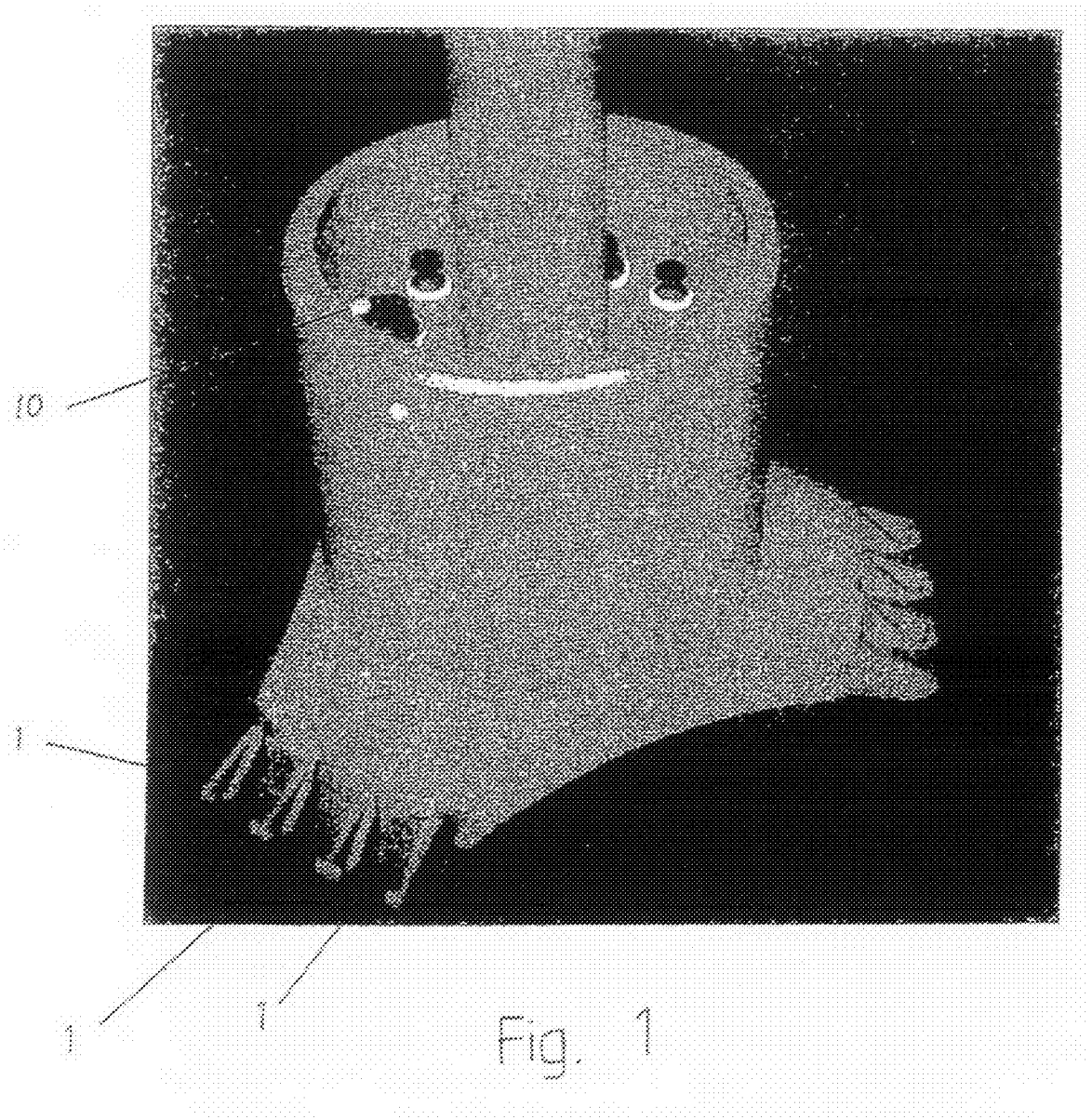

Method for anchoring of a vessel, with use of the system according to the invention.

10 Claims, 5 Drawing Sheets

MOORING PULL-IN SYSTEM

FIELD OF THE INVENTION

The present invention relates to anchoring of a vessel, preferably at deep waters, with spread anchoring preferably arranged tightly from the vessel. More particularly, the invention relates to a system and a method for anchoring of a vessel.

BACKGROUND OF THE INVENTION AND PRIOR ART

When a vessel, such as a FPSO—a vessel for floating production, storage and offloading—lies anchored, large forces are required to maintain the position of the vessel. The anchoring lines (the moorings) normally are spread out around a circumference of the vessel. Typically there are 50-100 tons tension in the anchoring lines for this purpose. Pull-in or connection of the anchoring lines is a comprehensive and expensive operation. Normally, the anchors are placed at the seabed in advance, with about half of the length of the anchoring line coupled to each specific anchor. On the vessel the upper half of the anchoring lines are connected, with a pin coupling through adapted lugs or fastening eyes. The locking pins are typically made from high strength steel with a diameter of 200 mm on the pin. The two halves of each anchoring line, of which the lower half is connected to the anchor and the upper half is connected to the vessel, are joined together by use of an installation vessel placed on the surface in position between the vessel and the anchor. For this purpose the upper end of the lower half of the anchoring line and the lower end of the upper half of the anchoring line, respectively, are pulled into the installation vessel, where the joining takes place. To have sufficient length and slack the locking pin in the vessel must be opened, and connected to a winch with a wire or similar the upper half of the anchoring line is fed out from the vessel. After complete joining the anchoring line is retrieved back to the vessel and locked with the locking pin, which is a difficult operation due to the huge tension in the anchoring line. The operation must be repeated for each anchoring line, resulting in significant time and cost spent, not at least because of the requirement of an expensive installation vessel. The locking means has proved to be susceptible to fatigue.

The objective of the present invention is to provide a system and a method for anchoring of a vessel, having distinguishing features making a separate installation vessel unnecessary, and in addition making the pull-in or coupling of the anchoring lines simpler, as well as improving the fatigue properties.

SUMMARY OF THE INVENTION

For the above-mentioned objective the present invention provides a system for anchoring of a vessel, preferably at deep waters, comprising a number of anchoring lines, each anchoring line extending from a fastening means on the vessel to an anchor at the seabed, and the anchoring lines are preferably tightly arranged, obliquely down into the sea around the vessel in the form of spread anchoring, such that the vessel maintains a fixed, intended position, distinguished in that each anchoring line is fastened to an anchor and extends in one length, without joinings, to an upper end where a coupling means is fastened, and the fastening means comprises a crib for each anchoring line, where each coupling means can be placed in a dedicated, fastened position.

With the term deep waters is meant ocean depths where it is natural to use relatively tight anchoring, preferably beyond 150 m depth of ocean, for example 800 m depth. With a number of anchoring lines is meant at least three anchoring lines, for example 9 anchoring lines. By arranging the anchoring lines tightly, is meant with a tension in the anchoring lines of above 10 tons, typically 50-100 tons (metric) tension, however, the tension can be up to several hundred metrical tons. That each anchoring is in one length, means that each anchoring line is without any joinings that must be made at sea, such that no joining is relevant during the installation. A crib is a fastening means such that a coupling means that is passed into the crib become fastened when the tension from a pulling wire connected to the coupling means is released. The coupling means thereby comprises for example cross oriented pins or locking means of any form having larger diameter than the anchoring line, and the crib typically comprises upwards extending locking pins having intermediate opening larger than the anchoring line diameter, but smaller than the locking pins or similar.

The tension of the anchoring lines during connection and as anchored, is typically 10-250 tons, preferably 50-100 tons. During pull-in the tension can for one or more anchoring lines temporarily be released. The anchoring line can be prepared from wire, chain, polyester, Kevlar, other polymers, or the anchoring line can be a composite construction. Preferably, the anchoring line along the substantial length thereof is prepared from polyester, because of low weight and cost, and convenient elasticity. Preferably, at least one swivel is arranged at the coupling part, which simplifies correct orientation around the longitudinal axis of the anchoring line of the locking pin or similar. Preferably, at least one locking means is arranged for each crib, for example in the form of a locking pin that hinders that the coupling part can be released from the crib. Preferably, a fastening means for a pulling wire is arranged in each coupling part. Further, a device is preferably arranged for tightening or adjustment of length of the anchoring line, for example ±2 m, which for example is in the form of a releasable, position adjustable fastening for the coupling part to the anchoring line, or for example a stay tightener.

With the invention also a method for anchoring of a vessel is provided, preferably at deep water, with use of the system of the present invention, distinguished in that a pulling wire is extended out from a winch on the vessel and fastened to the coupling part of an anchoring line, the anchoring line is pulled in with the winch to where the coupling part is in position over a crib, the coupling part is laid down into the crib, and the operation is repeated for each anchoring line.

In connection with the method a locking means is preferably fastened in place for each crib after the actual anchoring line having been laid into position. Further, tightening or adjustment of the anchoring line can be preferable.

DRAWINGS

The invention will be further illustrated with drawings, of which

Figure 2:
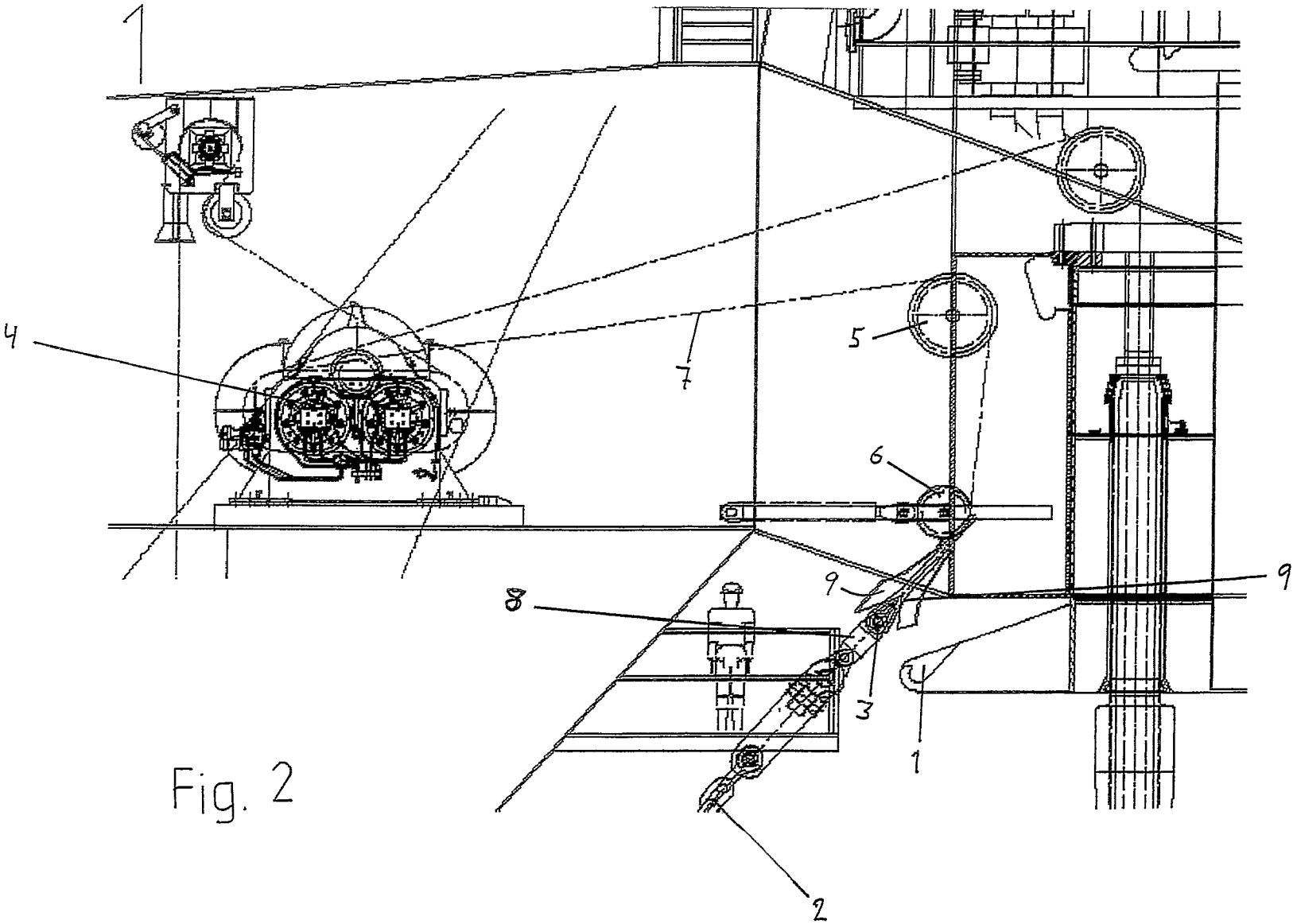
Figure 3:
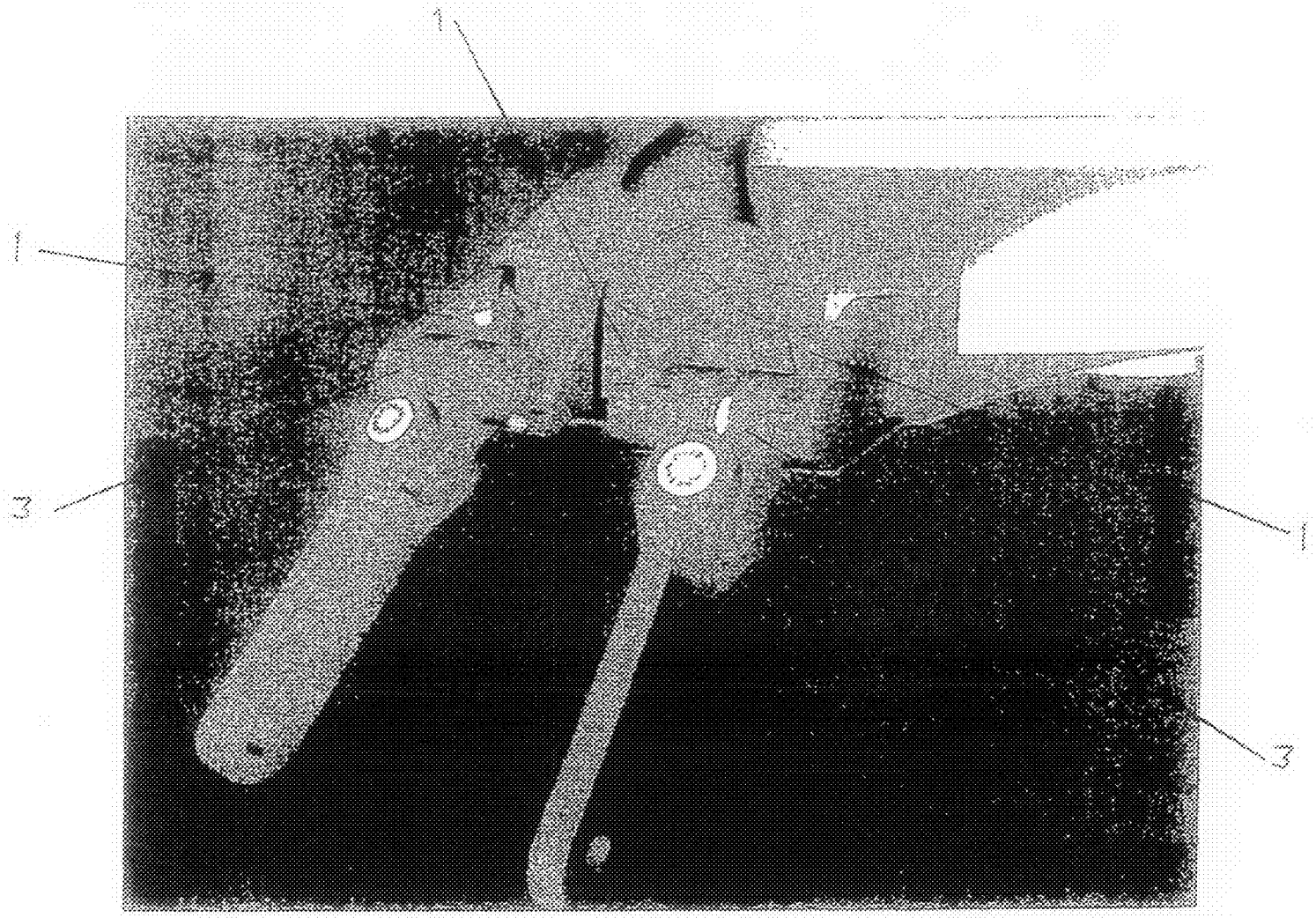
Figure 4:
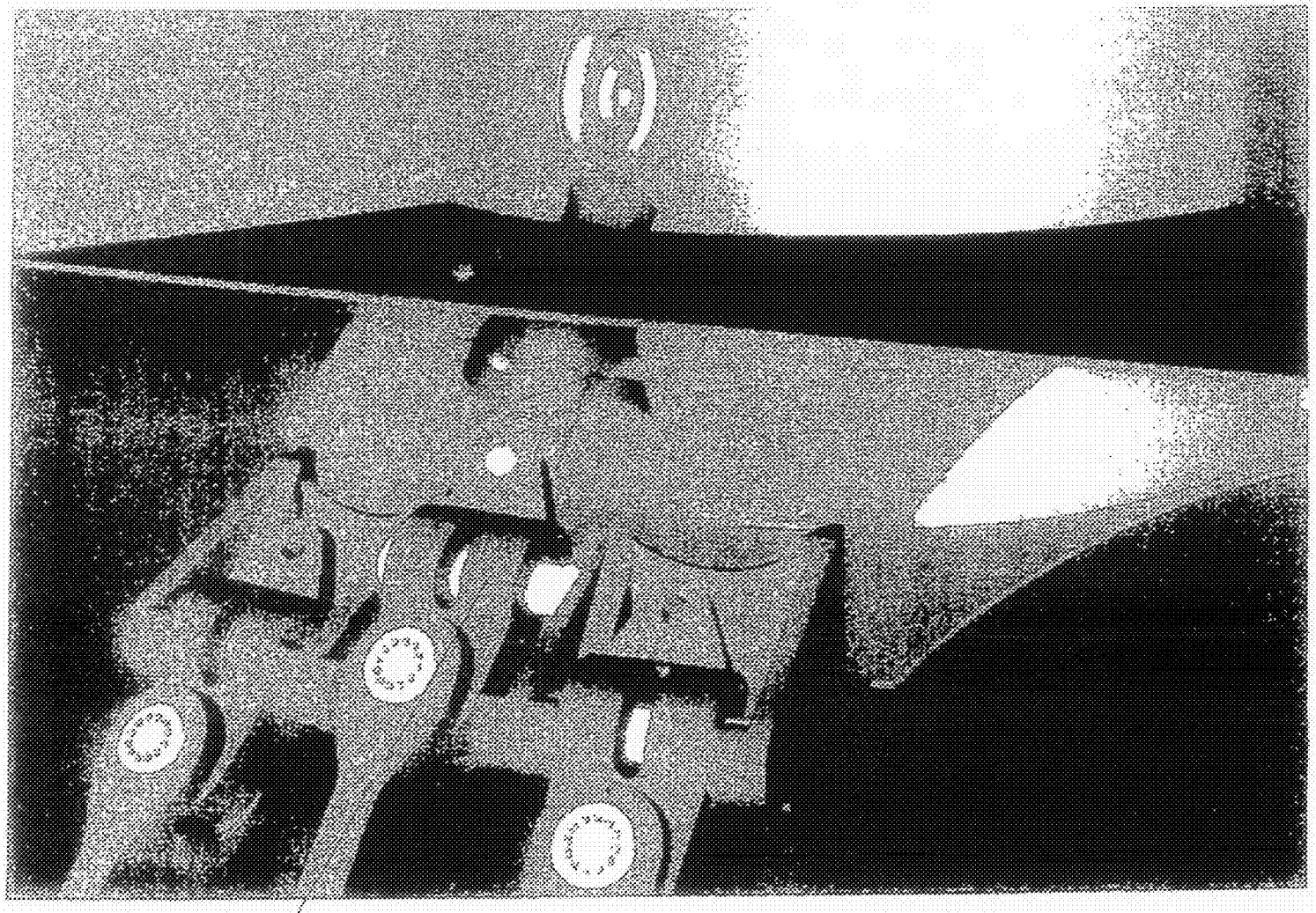
Figure 5:
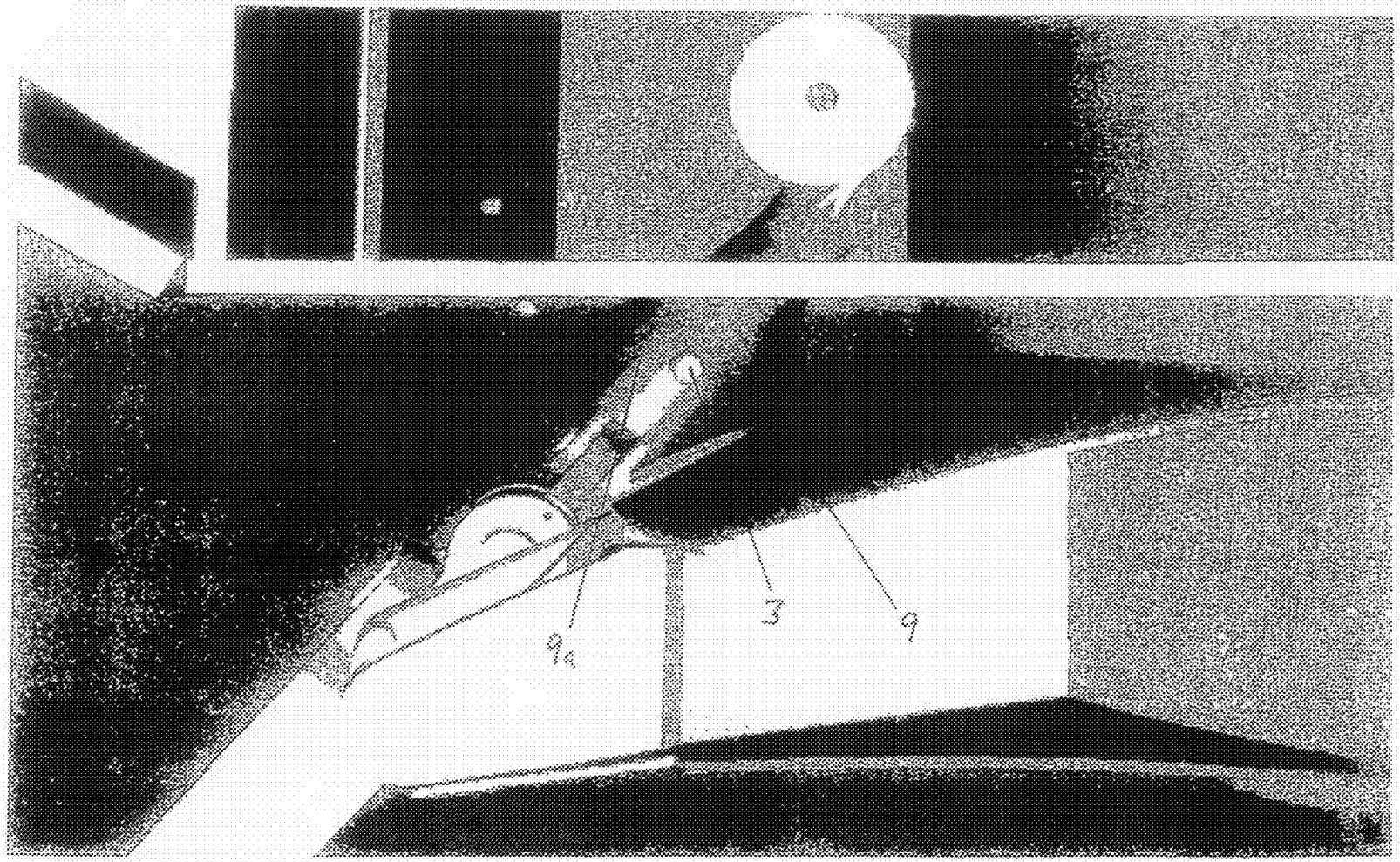

FIG. 1 illustrates the inner, geostationary part of a turret, with fastening means according to the invention, FIG. 2 illustrates pull-in of an anchoring line, in accordance with the invention, FIG. 3 illustrates two coupling parts that have been fastened in respective cribs, FIG. 4 illustrates how a further coupling part becomes fastened by lowering it down into a dedicated crib, and FIG. 5 illustrates a coupling part and a fastening means according to the invention.

DETAILED DESCRIPTION

Reference is first made to FIG. 1 illustrating the inner geostationary part of a turret. The turret is mounted into or on a vessel, and the vessel can rotate around the inner geostationary part of the turret. In the lower part of the turret 9, cribs are arranged for hanging up of respective anchoring lines. Cross bars on the coupling part in the upper end of each anchoring line, fit into the respective cribs. Also, hanged-up risers 10 are illustrated.

It is no proviso for the invention that a turret or an FPSO-vessel or similar is used. The vessel can be any floating installation such as a rig, as the cribs can be mounted for example in the corners of the rig.

With reference to FIG. 2, it is illustrated how the pull-in of an anchoring line 2 is undertaken in order to place the coupling part 3 into the crib 1. More particularly, a winch 4 with guiding sheaves 5 and 6, over which guiding sheaves a pull-in wire 7 is arranged, is used. The anchoring line is pulled in until the crossbar 3 is in position over the crib 1. Then the guiding sheave 6 is extended forwards by use of a cylinder 7 or similar, until the longitudinal axis of the anchoring line goes through the opening in the crib. It is preferably arranged a swivel 8 close to the end of the anchoring line and a rotation adjusting conus 9 just above the crib. The swivel is aiding in turning the crossbars 3 to correct position to fit straight into the crib. This can easily be achieved by pulling the crossbars into a groove in the conus 9. By correct alignment some wire is released from the winch 4, such that the locking pins are fastened into the crib.

On FIG. 3, two coupling parts are illustrated 3, as in place in cribs 1.

On FIG. 4, lowering into the crib of a third coupling part 3 is illustrated.

FIG. 5 illustrates the same as FIG. 4, but viewed from the side. The construction of the conus 9, with a rotation adjusting groove 9*a*, appears clearly. The cross bar 3 is turned to correct orientation as it is pulled into the openings 9*a*.

The different elements in the system according to the invention can be replaced by equivalent elements, provided that the distinguishing features of the system are maintained.

The invention claimed is:

1. A system for anchoring of a vessel, comprising:

a number of anchoring lines, each anchoring line extending from a fastening means on the vessel to an anchor at the seabed, and anchoring lines extending obliquely down into the sea around the vessel in the form of spread anchoring, such that the vessel is maintained in a fixed, intended position, wherein each anchoring line is fastened to an anchor and extends in one length, without joints, to an upper part where a coupling part having a larger diameter then the anchoring line is fastened, and the fastening means comprises a crib for each anchoring line, having an opening smaller than the coupling part but larger than the anchoring line and wherein each coupling part can be laid down into a dedicated fastened position, the system comprising a guiding sheave having an adjustable position for guiding and positioning of an anchor line or pulling wire at anchoring line pull in for laying down the coupling part into the crib.

2. The system according to claim 1, wherein the tension of each anchoring line is 50-100 metric tons.

3. The system according to claim 1, wherein the anchoring lines are prepared from polyester.

4. The system according to claim 1, further comprising a swivel arranged at the coupling part.

5. The system according to claim 1, further comprising a locking means arranged for each crib.

6. The system according to claim 1, further comprising a fastening means for pull-in wire arranged in each coupling part.

7. The system according to claim 1, further comprising a means for tightening/adjustment of length of each anchoring line.

8. A method for anchoring of a vessel with use of the system according to claim 1, wherein a pull-in wire is extended out from a winch on the vessel and fastened to the coupling part on an anchoring line, the anchoring line is pulled in with the winch to the coupling part is in position over a crib, the coupling part is laid down into the crib, and the operation is repeated for each anchoring line.

9. The method according to claim 8, further comprising a locking means is mounted on each crib.

10. The method according to claim 8, further comprising tightening adjustment of length of each anchoring line.

* * * * *